United States Patent [19]

Owen

[11] Patent Number: 4,874,128

[45] Date of Patent: Oct. 17, 1989

[54] RAIL-TIE FASTENING ASSEMBLY

[75] Inventor: S. Hudson Owen, Marshfield, Wis.

[73] Assignee: Kerr-McGee Chemical Corporation, Oklahoma City, Okla.

[21] Appl. No.: 128,174

[22] Filed: Dec. 3, 1987

[51] Int. Cl.[4] ..... E01B 2/00; E01B 9/00

[52] U.S. Cl. ..... 238/355; 238/264; 238/287; 238/310

[58] Field of Search ..... 238/264, 265, 275, 276, 238/278, 290, 291, 304, 306, 307, 310, 315, 338, 351, 357, 355, 297

[56] References Cited

U.S. PATENT DOCUMENTS

| | | | |
|---|---|---|---|
| 332,384 | 12/1885 | Conley | 238/331 |
| 571,064 | 11/1896 | Campbell | 238/291 |
| 1,022,790 | 4/1912 | Kupp | 238/265 |
| 1,036,749 | 8/1912 | Treharne | 238/331 |
| 1,047,687 | 12/1912 | Myers | 238/290 |
| 1,054,553 | 2/1913 | Hoyet et al. | 238/290 |
| 1,058,802 | 4/1913 | Smith | 238/292 |
| 1,864,665 | 6/1932 | Northey et al. | 238/304 |
| 2,035,918 | 3/1936 | Preston | 238/338 |
| 2,107,131 | 2/1938 | Schwinn | 238/349 |
| 2,140,917 | 12/1938 | Mahood | 238/338 |
| 2,167,870 | 8/1939 | Boyce | 238/338 |
| 2,522,314 | 9/1950 | Spencer | 238/315 |
| 3,059,855 | 10/1962 | Gallagher | 238/327 R |
| 3,476,317 | 11/1969 | Gassner | 238/290 |
| 3,558,049 | 1/1971 | Pennino | 238/29 |
| 3,910,493 | 10/1975 | Wood | 238/349 |
| 3,920,183 | 11/1975 | Houghton | 238/283 |
| 4,050,284 | 9/1977 | Miller | 72/84 |
| 4,068,593 | 1/1978 | Leeves | 104/307 |
| 4,073,435 | 2/1978 | Miller | 238/349 |
| 4,104,483 | 8/1978 | Seeley | 174/138 R |
| 4,141,500 | 2/1979 | Gragnani | 238/304 |
| 4,278,204 | 7/1981 | Miller | 239/349 |
| 4,300,380 | 11/1981 | Checkley | 72/306 |
| 4,319,392 | 3/1982 | Cutts | 29/402.08 |
| 4,349,150 | 9/1982 | Lubbers | 238/265 |
| 4,349,151 | 9/1982 | Schumaker | 238/349 |
| 4,350,291 | 9/1982 | Dobson | 238/349 |
| 4,409,901 | 10/1983 | Hark | 104/7.2 |
| 4,413,777 | 11/1983 | Brown | 238/349 |
| 4,461,422 | 7/1984 | Harkus | 238/366 |
| 4,466,569 | 8/1984 | Taylor | 238/1 |
| 4,479,440 | 10/1984 | Burr et al. | 104/307 |
| 4,513,912 | 4/1985 | Schumaker | 238/349 |
| 4,566,631 | 1/1986 | Brown | 238/349 |
| 4,580,338 | 4/1986 | Badger | 29/759 |

FOREIGN PATENT DOCUMENTS

| | | | |
|---|---|---|---|
| 302041 | 4/1915 | Fed. Rep. of Germany | 238/297 |

*Primary Examiner*—Robert B. Reeves
*Assistant Examiner*—Joseph D. Pape
*Attorney, Agent, or Firm*—William G. Addison

[57] ABSTRACT

A rail-tie fastening assembly for connecting a rail having a rail flange to a tie comprising a rail seat assembly and a rail anchor. The rail seat assembly is connectible to the tie and includes an anchor slot and a seat hook assembly. The seat hook assembly is adapted to extend a distance over an upper surface of the rail flange. The rail anchor includes an anchor hook assembly adapted to extend over on the upper surface of the rail flange in an assembled position of the rail anchor to the rail seat assembly. The rail anchor is insertible through the anchor slot in the rail seat assembly to the assembled position. The seat hook assembly is spaced a distance from the upper surface of the rail flange to cooperate in permitting vertical movement of the rail in the assembled position of the rail anchor to the rail seat assembly. Tne anchor hook assembly engages one side of the rail flange and the seat hook assembly engages the opposite side of the rail flange to restrain lateral movement. A base anchor is connected to the rail seat assembly and the base anchor in disposable in a cavity formed in an upper surface of the tie and the base anchor is secured to the tie, thereby securing the rail seat assembly to the tie.

66 Claims, 6 Drawing Sheets

RAIL-TIE FASTENING ASSEMBLY

FIELD OF THE INVENTION

The present invention relates generally to fastening means for securing a railroad rail to a cross-tie. More particularly, but not by way of limitation, it relates to a rail-tie fastening assembly having a rail seat assembly connectable to the tie and a rail anchor removably insertable through a portion of and connectable to the rail seat assembly.

DESCRIPTION OF THE PREFERRED EMBODIMENTS

Figure 1:
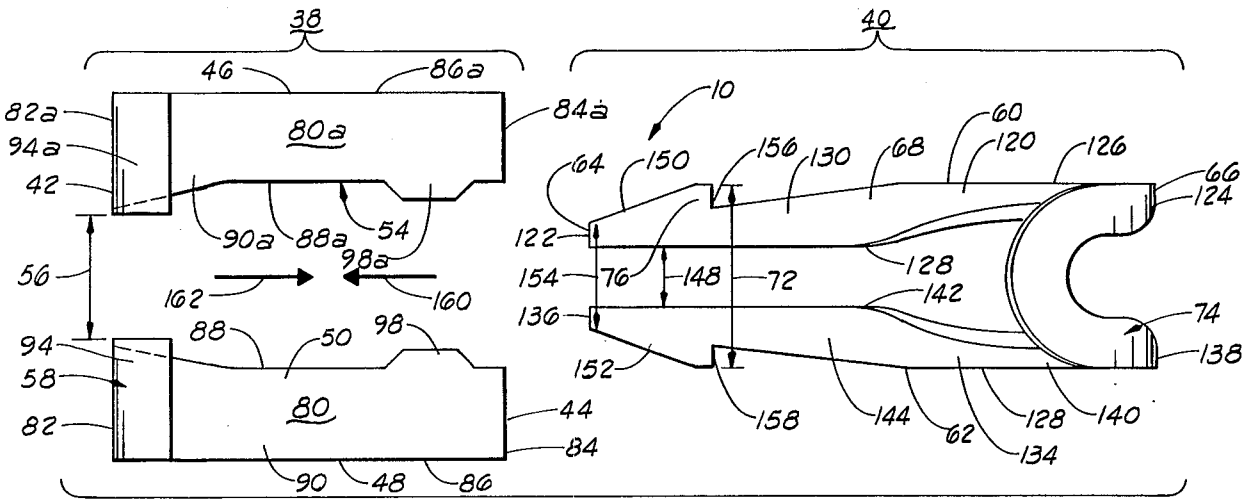
FIG. 1 is a top plan view of a rail-tie fastening assembly showing a rail seat assembly and a rail anchor in an unassembled position.

In the past, railroad rails have been fastened to wood cross ties by means of offset head cut track spikes. The spikes have been driven into the ties through holes in the tie plates, the latter being positioned between the rail and the tie. The offset head of the spike was driven down upon the flange of the rail to hold the rail in place.

Correctly installed, there was a vertical gap between the spike offset head and the rail flange to allow for rail lift between train wheel passages. In this fashion, the rail was allowed or permitted to "float" upward and downward over a distance of about one-eighth of an inch, with the rail still being restrained from lateral, side-to-side, movement by the driven spikes.

Advantages of the track spike-tie plate-rail anchor fastening system just described included low cost and ease of installation and removal with hand tools. This spike fastener system relied upon friction between the spike and the wood tie to hold the system. This system restrained forces lateral to the track by shear resistance between the rail and the tie plate, and between the tie plate and the tie using the spike to transfer the shear.

In this prior system just described, longitudinal restraint along the rail of forces caused by rail temperature change, traction and braking forces was usually provided by rail anchors installed on the rail flange and bearing on the top edge of the side of the tie. The rail anchors in service provided longitudinal restraint in only one direction, so they usually were placed on both sides of the tie thereby forming a "box", requiring four rail anchors per tie. For economy, most railroads installed rail anchors on every third of fourth tie.

Various problems were associated with this prior type of fastening system such as "plate cutting" (wear of the top tie surface under the tie plate), "spike kill" (enlargement of the spike hole reducing the friction-anchoring ability of the spike), and wear on the tie edges caused by relative movement of the anchor moving up and down with rail lift from the stationary tie.

One of the most serious problems associated with this prior system of anchoring rails to ties was gauge widening, particularly on curves, where lateral forces from rail car wheels tended to push the rails apart. Sufficient gauge widening can cause derailment of a train, so track maintenance personnel were required to pay relatively close attention to track gauge. Usual maintenance procedures in the past to correct an over-width gauge included pulling the track spikes, plugging the holes with treated wood dowels, regauging the track rails, and reinstalling the track spikes-tie plates-rail anchors. Heavier wheel loads, higher train speeds, increased train frequency, weather and other adverse track conditions required this maintenance cycle to be repeated often, thereby reducing tie life and increasing track maintenance costs.

The present invention solves the problems associated with the prior installation system just described, while retaining ease of installation and removal with simple hand tools. Significantly, the improved rail-tie fastening assembly of the present invention allows for "rail lift", making it fully compatible with the track spike system previously described. The rail-tie fastening assembly of the present invention can be installed on a tie immediately adjacent the track spike system described above, and neither the rail nor the ballast will "see" any difference.

Figure 2:
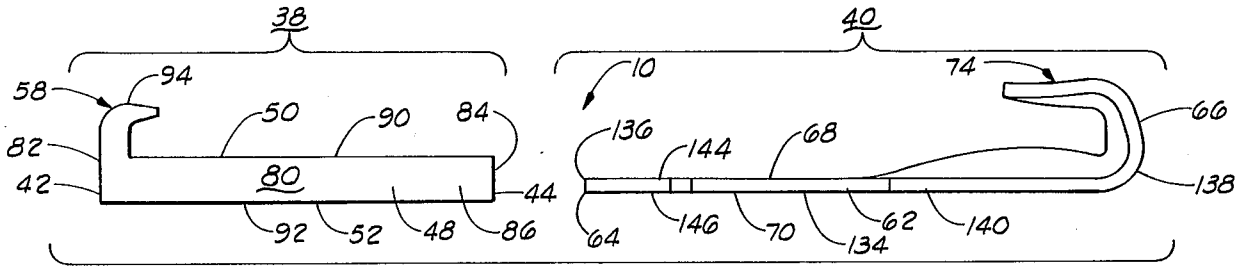
FIG. 2 is a side elevational view of the rail-tie fastening assembly of FIG. 1 showing the rail seat assembly and the rail anchor in the unassembled position.
Figure 9:
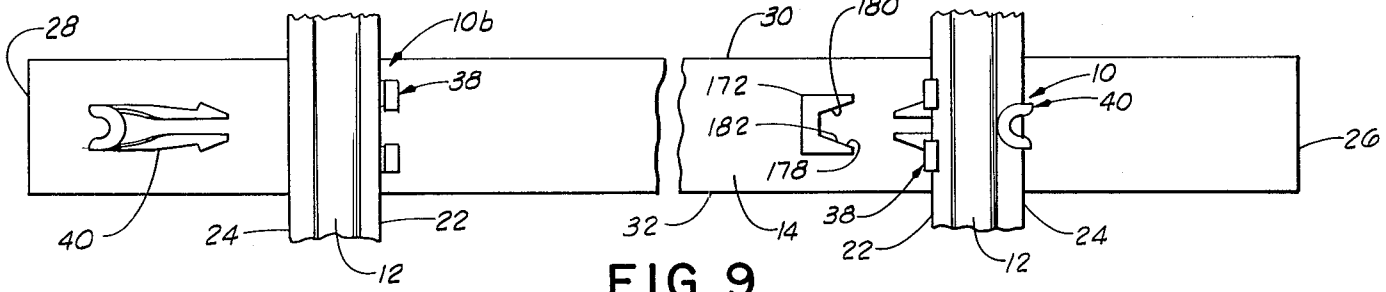
FIG. 9 is a plan view of the tie showing two rail seat assemblies installed thereon with the rail anchor being assembled to one of the rail seat assemblies and with the rail anchor and the other seat assembly being shown in a position prior to moving the rail anchor to the assembled position, a portion of two rails being shown with one rail positioned on each rail seat assembly. A plan view of a removal tool for assisting in moving the rail anchor from the assembled position to the unassembled position is shown near one of the rail seat assemblies.
Figure 10:
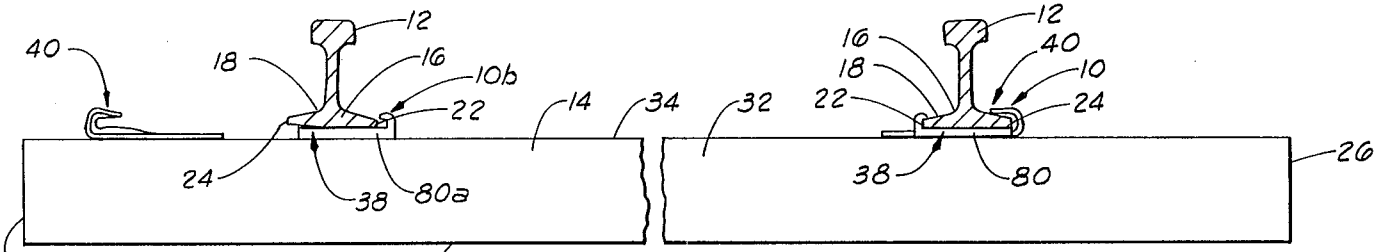
FIG. 10 is a side elevational view of the tie with two rail seat assemblies and two rail anchors shown in the positions indicated in FIG. 9, the rails being shown in section.

As shown in FIGS. 1, 2, 3 & 4, the present invention comprises a rail-tie fastening assembly 10 which is adapted to connect a rail 12 (FIGS. 3 and 4) to a tie 14 (FIGS. 3 and 4), the tie 14 sometimes being referred to herein as a "cross tie". The rail 12 (shown in FIGS. 3 and 4) includes a rail flange 16 having upper and lower surfaces 18 and 20 and first and second sides 22 and 24. As shown in FIGS. 5, 6, 9 and 10, the tie 14 has first and second ends 26 and 28, as shown in FIGS. 5, 9 and 10, first and second sides 30 and 32, and, as shown in FIGS. 9, upper and lower surfaces 34 and 36. The tie 14 may be constructed of wood, metal, concrete or any other material suitable for supporting rails 12. Each rail-tie fastening assembly 10 includes a rail seat assembly 38 (FIGS. 1 and 2) and a rail anchor 40 (FIGS. 1 and 2).

As shown more clearly in FIGS. 1 and 2, the rail seat assembly 38 has first and second ends 42 and 44, first and second sides 46 and 48, and upper and lower surfaces 50 and 52. An anchor slot 54 is formed through a portion of the rail seat assembly 38. The anchor slot 54 extends through a portion of the rail seat assembly 38 intersecting the first and second ends 42 and 44 thereof. The anchor slot 54 has a predetermined slot width 56 (shown in FIG. 1).

A seat hook assembly 58 is formed on the rail seat assembly 38, generally near the first end 42 thereof. The seat hook assembly 58 is adapted to engage the first side 22 of the rail flange 16. A portion of the seat hook assembly 58 extends a distance generally over a portion of the upper surface 18 of the rail flange 16, generally near the first side 22 of the rail flange 16. As shown more clearly in FIG. 3, the rail seat assembly 38 is installed generally on the upper surface 34 of the tie 14 with the upper surface 50 of the rail seat assembly 38 being spaced a distance upwardly from the upper surface 34 of the tie 14.

As shown in FIGS. 1, 2, 3, and 4, the rail anchor 40 has first and second sides 60 and 62, first and second ends 64 and 66, and upper and lower surfaces 68 and 70. The rail anchor 40 is movable from a normal position to a compressed position to be described below and movable from the compressed position to the normal position. The rail anchor 40 has an anchor width 72 extending generally between the first and second sides 60 and 62 thereof in the normal position of the rail anchor 40. The anchor width 72 is greater than the slot width 56 formed in the rail seat assembly 38 in the normal position of the rail anchor 40. The anchor width 72 is less than the slot width 56 formed in the rail seat assembly 38 when the rail anchor 40 is moved to the compressed position. An anchor hook assembly 74 is formed on the second end 66 of the rail anchor 40. The anchor hook assembly 74 is adapted to extend a distance generally over a portion of the upper surface 18 of the rail flange 16, generally near the second side 24 of the rail flange 16.

The first end 64 of the rail anchor 40 is insertable through the anchor slot 54, generally at the second end 44 of the rail seat assembly 38 in the compressed position of the rail anchor 40. The rail anchor 40 is movable through the anchor slot 54 to an assembled position. In the assembled position, the anchor hook assembly 74 extends generally over a portion of the upper surface 18 of the rail flange 16, generally near the second side 24 of the rail flange 16. The rail anchor 40 is movable from the compressed position to the normal position in the assembled position of the rail anchor 40.

The rail anchor 40 includes seat engaging means 76 positioned generally near the first end 64 of the rail anchor 40. The engaging means 76 is adapted to engage a portion of the rail seat assembly 38 when the rail anchor 40 in the assembled position connected to the rail seat assembly 38 and in the normal position of the rail anchor 40.

As shown more clearly in FIGS. 1 and 2, the rail seat assembly 38 includes a first rail seat plate 80 having first and second ends 82 and 84, first and second sides 86 and 88, and upper and lower surface 90 and 92. A first seat hook 94 is formed on the first end 82 of the rail seat plate 80. The first seat hook 94 is shaped and adapted to engage the first side 22 of the rail flange 16. A portion of the first seat hook 94 is shaped and adapted to extend generally over a portion of the upper surface 18 of the rail flange 16, generally near the first side 22 of the rail flange 16. More particularly, the seat hook 94 is shaped so that a portion of the seat hook 94 extends generally over a portion of the upper surface 18 of the rail flange 16 and is spaced a distance 96 (FIG. 3) from the upper surface 18 of the rail flange 16, for reasons which will be made more apparent below.

Figure 4:
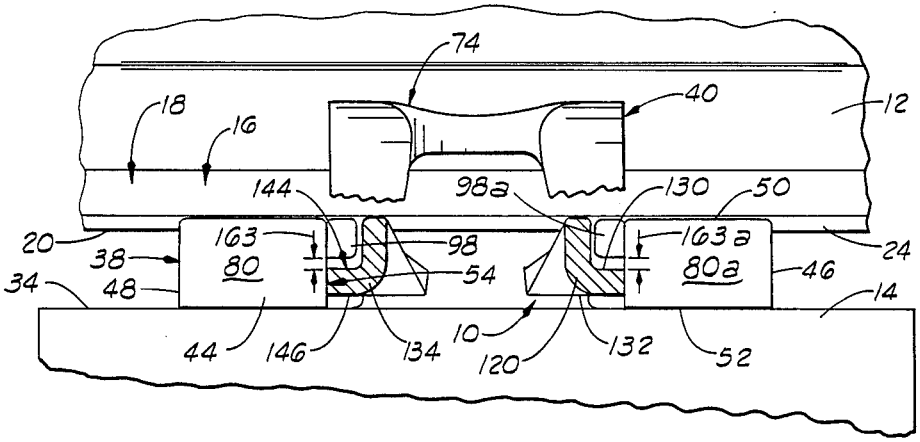
FIG. 4 is an end elevational view, partial sectional of the rail-tie fastening assembly showing the rail seat assembly and the rail anchor in the assembled position, and showing an elevational view of a portion of a rail and a portion of a tie.
Figure 5:
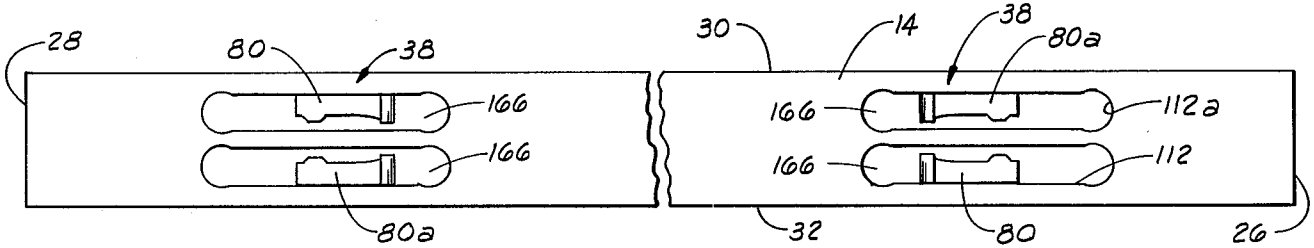
FIG. 5 is a plan view of a railroad tie showing two rail seat assemblies installed on the tie.

As shown more clearly in FIG. 4, an ear 98 is formed on the second side 88 of the rail seat plate 80, generally near the second end 84. The ear 98 extends a distance outwardly from the second side 88. The ear 98 is disposed generally near the upper surface 90 and the ear 98 is spaced a distance from the lower surface 92 of the rail seat plate 80.

As shown more clearly in FIGS. 1 and 4, the rail seat assembly 38 also includes a second rail seat plate **80*a* which is constructed and operates exactly like the rail seat plate 80 described before. Thus, the various components of the rail seat plate 80*a* are designated in the drawings with the same reference numerals as like components of the rail seat plate 80, except the various components of the rail seat plate 80*a*** also include the additional letter designation "a".

As shown more clearly in FIGS. 4 and 5 and as indicated in FIG. 1, the rail seat plates 80 and **80*a* each are disposed generally on the upper surface 34 of the tie 14. They are disposed generally in parallel extending planes. As shown more clearly in FIG. 1, the second side 88 of the rail seat plate 80 is spaced a distance from the second side 88*a* of the rail seat plate 80*a*. The second sides 88 and 88*a* cooperate with the spacing therebetween to form the anchor slot 54 in the rail seat assembly 38, and the distance between the second sides 88 and 88*a* is equal to the slot width 56. The seat hooks 94 and 94*a* cooperate to form the seat hook assembly 58 of the rail seat assembly 38**.

The rail seat plates 80 and **80*a*** function to transmit the vertical load of the rail wheel directly to the tie and spread such load over the surface of the tie to reduce stress on the tie and to stiffen the tie section under the rail.

As shown in the drawings and as described before, the rail seat plates 80 and **80*a* are two separate, unconnected components. In another embodiment, not shown, the rail seat plates 80 and 80*a* could be connected together. This would fix the relationship between the two rail seat plates 80 and 80*a* prior to installation on the tie 14**.

Figure 6:
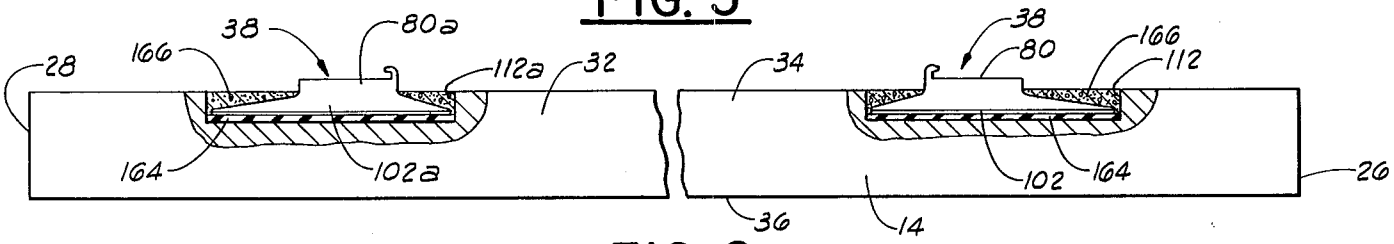
FIG. 6 is a side elevational, partial sectional view of the tie of FIG. 5 with the two rail seat assemblies installed thereon, a base anchor being shown with each rail seat assembly for cooperating to anchor the rail seat assemblies to the tie.
Figure 8:
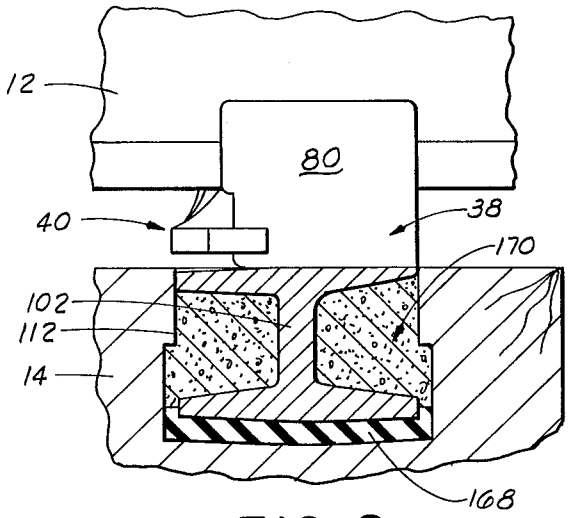
FIG. 8 is a sectional view, similar to FIG. 7, but showing an alternative installation of the rail seat assembly on the tie utilizing the base anchor.

As shown in FIGS. 6 and 8, a base anchor 102 is connected to the lower surface 92 of the rail seat plate 80. The base anchor 102 has a generally I-shaped cross section (shown in FIG. 8).

Figure 7:
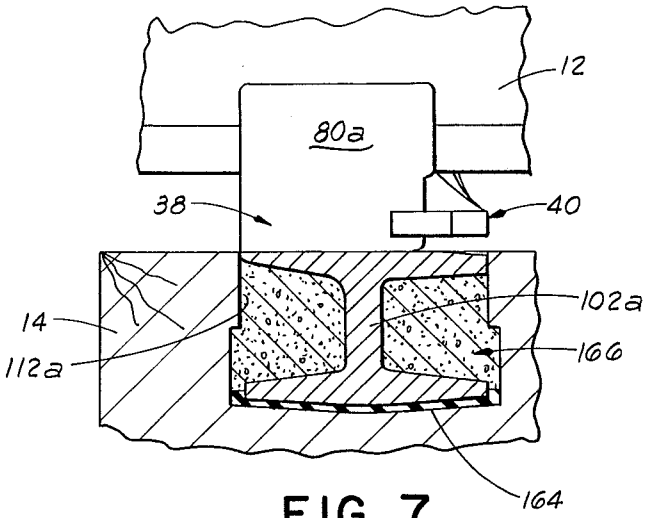
FIG. 7 is a sectional view of a portion of a tie showing a portion of the base anchor used in the installation of the rail seat assembly on the tie.

The rail tie fastening assembly 10 also includes a second base anchor **102*a* (FIGS. 6 and 7). The second base anchor 102*a* is connected to the lower surface 92*a* of the rail seat plate 80*a*. The base anchor 102*a* has a generally I-shaped cross section (FIG. 7**).

As shown more clearly in FIGS. 5 and 8, a cavity 112 is formed in the upper surface 34 of the tie 14. The cavity 112 is sized to receive the base anchor 102. The cavity 112 and the base anchor 102 each are sized so that, when the base anchor 102 is disposed in the cavity 112, the lower surface 92 of the rail seat plate 80 is disposed in a plane generally coplanar with the upper surface 34 of the tie 14.

A second cavity 112*a* (shown in FIGS. 5 and 7) is formed in the upper surface 18 of the tie 14 and the second cavity 112*a* is constructed and shaped exactly like the cavity 112. The second cavity 112*a* is sized and shaped to receive the base anchor 102*a* for supporting the rail seat plate 80*a* in a manner exactly like that described before with respect to the cavity 112, the base anchor 102 and the rail seat plate 80.

As shown more clearly in FIG. 5, the cavities 112 and 112*a* are formed in the upper surface 34 of the tie 14 and spaced a distance apart to support the respective rail seat plates 80 and 80*a* in such a manner that they are oriented and spaced a distance apart to form the rail seat assembly 38 in the manner described before. The base anchors 102 and 102*a* are secured in the respective cavities 112 and 112*a* with an adhesive and potting compound in a manner to be described below.

As shown more clearly in FIGS. 1, 2 and 4, the rail anchor 40 includes a first tine 120 having first and second ends 122 and 124, first and second sides 126 and 128, upper and lower surfaces 130 and 132. The rail anchor 40 also includes a second tine 134 having first and second ends 136 and 138, first and second sides 140 and 142, and upper and lower surfaces 144 and 146 (FIG. 4). The second ends 124 and 138 of the respective first and second tines 120 and 134 are connected together so that the tines 120 and 134 extend in generally parallel extending planes with the second side 128 of the first tine 120 generally facing and being spaced a distance 148 from the second side 142 of the second tine 134.

The distance between the first side 126 of the first tine 120 and the first side 140 of the second tine 134 forms the anchor width 72.

In the particular embodiment of the rail anchor 40 shown in the drawings, the anchor hook assembly 74 includes one portion which connects the second end 124 of the first tine 120 to the second end 138 of the second tine 134. More particularly, as shown in the drawings, the anchor hook assembly 74 and the first and the second tines 120 and 134 are integrally constructed from a single unitary piece of metallic material.

A tapered portion 150 (FIG. 1) is formed on the first side 126 of the first tine 120 generally near and intersecting the first end 122. The tapered portion 150 extend a distance generally from the first end 122 toward the second end 124 of the first tine 120. A tapered portion 152 (FIG. 1) is formed on the first side 140 of the second tine 134, generally near and intersecting the first end 136 of the second tine 134. The tapered portion 152 extends a distance generally along the first side 140 generally from the first end 136 toward the second end 138. The tapered portions 150 and 152 cooperate to provide a first end width 154 (FIG. 1) of the rail anchor 40 which is less than the anchor width 72 and less than the slot width 56 of the anchor slot 54. Thus, the first end portion 64 of the rail anchor 40 has a first end width 154 sized so that the first end portion of the rail anchor 40 is insertable a distance into the anchor slot 54 to facilitate the insertion of the rail anchor 40 into the anchor slot 54, in a manner to be described in greater detail below.

A seat surface 156 (FIG. 1) is formed on the first side 126 of the first tine 120, generally near the beginning of the tapered portion 150. The seat surface 156 is spaced a distance from the first end 122 of the first tine 120.

A seat surface 158 (FIG. 1) is formed on the first side 140 of the second tine 134, generally near the beginning of the tapered portion 152. The seat surface 158 is spaced a distance from the first end 136 of the second tine 134. The seat surfaces 156 and 158 cooperate to secure the rail anchor 40 within the rail seat assembly 38 in a manner to be described in greater detail below.

To install the apparatus of the present invention (as illustrated in FIGS. 5 through 10), the two cavities 112 and 112*a* first are formed in the upper surface 34 of the tie 14. The base anchor 102 along with the rail seat plate 80 connected thereto is disposed in the cavity 112 and the base anchor 102*a* along with the rail seat plate 80*a* connected thereto is disposed in the cavity 112*a*. The base anchors 102 and 102*a* each are positioned in the respective cavities 112 and 112*a* so that the rail seat plates 80 and 80*a* are oriented in the aligned, spaced apart manner described before. In this position, the base anchors 102 and 102*a* each are secured in the respective cavities 112 and 112*a* to secure the rail seat assembly 38 in the upper surface 34 of the tie 14 in a manner to be described in greater detail below.

After the rail seat assembly 38 has been connected to the upper surface 34 of the tie 14, the rail flange 16 of the rail 12 is positioned generally on the upper surfaces 90 and 90*a* of the rail seat plates 80 and 80*a* in a position whereby the lower surface 20 of the rail 12 is disposed generally on the upper surfaces 90 and 90*a* of the rail seat plates 80 and 80*a* and the first side 22 of the rail flange 16 generally faces and is spaced a distance from the seat hooks 94 and 94*a*. The rail anchor 40 then is positioned so that the first end 64 of the rail anchor 40 is disposed generally adjacent the anchor slot 54 with a portion of the first end portion 64 of the rail anchor 40 being disposed generally within a portion of the anchor slot 54 generally adjacent the second end 44 of the rail seat assembly 38.

In this position, the operator drives the rail anchor 40 in the insertion direction 160 (FIG. 1) generally from the second end 44 toward the first end 42 into the anchor slot 54. As the operator drives the rail anchor 40 in the insertion direction 160, the tapered portions 150 and 152 engage the second sides 88 and 88*a* of the rail seat plates 80 and 80*a* thereby forcing the first end 122 and 136 portions of the respective first and second tines 120 and 134 generally toward each other. The operator continues to drive the rail anchor 40 in the insertion direction 160 until the tapered portions 150 and 152 have been disposed entirely within the anchor slot 54, thereby resulting in the second sides 128 and 142 of the first and the second tines 120 and 134, respectively, being moved generally toward each other to a position wherein the rail anchor 40 has been moved to the compressed position and the anchor width 72 has been reduced to about the same size as the slot width 56.

In this compressed position of the rail anchor 40, the operator continues to force or drive the rail anchor 40 in the insertion direction 160 thereby moving the rail anchor 40 further through the anchor slot 54 until the seat surfaces 156 and 158 are moved slightly beyond the first end 42 of the rail seat assembly 38. The seat surfaces 156 and 158 form a reduced width portion of the rail anchor 40 thereby permitting the second sides 128 and 142 to be moved apart to a position wherein the first and the second tines 120 and 134 return to the normal position when the rail anchor 40 has been moved to the assembled position within the rail seat assembly 38. In the normal position, the seat surface 156 on the first tine 120 of the rail anchor 40 is in a normal position wherein the seat surface 156 engages a portion of the first end 82 of the rail seat plate 80 and the seat surface 158 on the second tine 134 of the rail anchor 40 is in a normal position wherein the seat surface 158 engages a portion of the first end 82*a* of the rail seat plate 80*a*. The engagement between the seat surfaces 156 and 158 and the first end 42 portions of the rail seat assembly 38 cooperate to prevent the rail anchor 40 from being moved in a removal direction 162 (FIG. 1), thereby securing the rail anchor 40 in the assembled position and in the normal position connected to the rail seat assembly 38.

The anchor hook assembly 74 is shaped and positioned on the rail anchor 40 so that the anchor hook assembly 74 engages the second side 24 of the rail flange 16 and a portion of the anchor hook assembly 74 extends over a portion of the upper surface 18 of the rail flange 16 in the assembled position and in the normal position of the rail anchor 40 connected to the rail seat assembly 38. Further, the anchor hook assembly 74 is adapted so that a portion of the anchor hook assembly 74 engages a portion of the upper surface 18 of the rail flange 16 in this assembled and normal position of the rail anchor 40 connected to the rail seat assembly 38.

Figure 3:
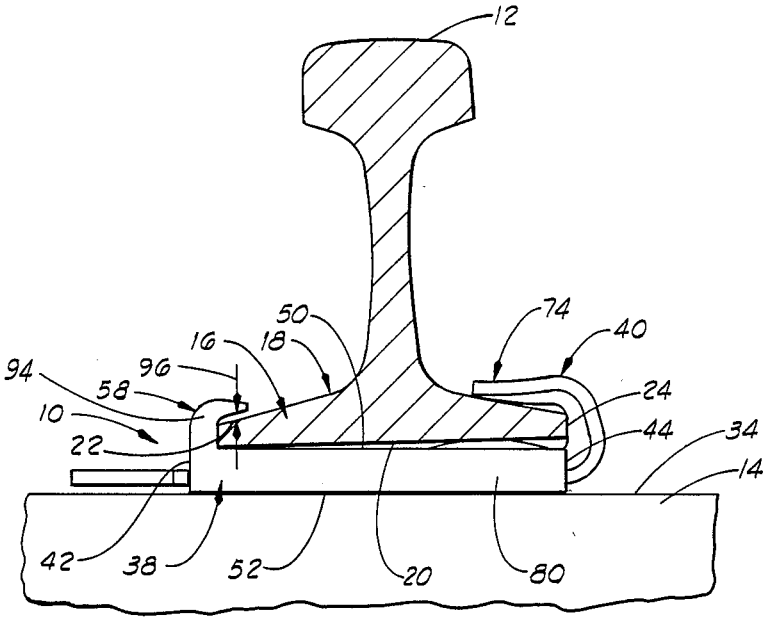
FIG. 3 is a side elevational view of the rail-tie fastening assembly showing the rail seat assembly and the rail anchor in an assembled position, and showing a cross sectional view of a rail and a portion of a tie.

As shown in FIG. 4, when the rail anchor 40 and the rail seat assembly 38 are in the assembled position, the upper surface 130 of the first tine 120 is spaced a distance 163 (FIG. 4) from the ear 98 and the upper surface 144 of the second tine 134 is spaced a distance 163*a* (FIG. 4) from the ear 98*a*. As shown in FIG. 3, the seat hooks 94 and 94*a* each extend a distance over a portion of the upper surface 18 of the rail flange 16 and are each spaced the distance 96 (FIG. 3) from the upper surface 18 of the rail flange 16. Due to the spacing between the rail anchor 40 (FIG. 4) and the ears 98 and 98*a* and the spacing between the seat hooks 94 and 94*a* and the upper surface 18 of the rail flange 16, the rail 16 is permitted to "float" or to move vertically even though the rail flange 16 is clamped between the seat hook assembly 58 and the anchor hook assembly 74.

Further, in this assembled and normal position with the rail anchor 40 connected to the rail seat assembly 38 and the rail tie-fastening assembly 10 connected about the rail flange 16, the seat hook assembly 58 engages the first side 22 of the rail flange 16 and the anchor hook assembly 74 engages the second side 22 of the rail flange 16. Due to this engagement, lateral movement of the rail 16 is restricted when the rail 16 is connected to the rail tie fastening assembly 10. However, the rail 12 is free to "float" up with rail lift because of the spaces formed between the rail anchor 40 and the rail seat assembly 38 defined by the distances 163 and 163*a* and because of the space formed by the distance 96 between the seat hook assembly 58 and the upper surface 18 of the rail flange 16. Vertical movement of the rail 12 is permitted only within these limits by the rail-tie fastening system 10 to allow for rail lift between wheel passages. Overturning moments, either way, on the rail 12 by lateral wheel forces are prevented by the seat hook assembly 58 and the ears 98 and 98*a*. These components thus restrict rail rotation to a very small angle and provide improved resistance to rail overturning moments as compared to prior art track-spike off-set head systems.

The rail-tie fastening system 10 of the present invention also provides longitudinal restraint against rail temperature change, traction and braking forces along the rail 12. The rail anchor 40 is in essence a spring designed so that the anchor hook assembly 74, when driven over the rail flange 16, has sufficient frictional force to transmit the longitudinal forces directly to the inside surface 88 of the rail seat assembly 38 and through the rail seat assembly 38 to the potting compound (to be described below), the tie 14 and into the ballast under the tie 14. Wear from longitudinal forces thus is restricted to a steel-steel interface between the rail seat assembly 38 and the rail anchor 40 instead of a steel-wood interface as in the prior track-spike-tie plate-rail anchor system.

As shown in FIGS. 5, 6, and 10, a typical system of the invention includes two rail-tie fastening assemblies 10 and 10*b* connected to the upper surface 34 of the tie 14. The rail-tie fastening assembly 10 is disposed generally near and spaced a distance from the first end 26 of the tie 14 and the second rail-tie fastening assembly 10*b* is disposed generally near and spaced a distance from the second end 28. The second rail-tie fastening assembly 10*b* is constructed, connected to the tie 14, and operates exactly like the rail-tie fastening assembly 10 described in detail before and below, except the second rail-tie fastening assembly 10*b* is rotated 180° with respect to the orientation of the first rail-tie fastening assembly 10. Since a typical tie 14 includes the two rail-tie fastening assemblies 10 and 10*b*, as described before, the tie 14 also will include two additional cavities for connecting the rail seat assemblies 38 to the upper surface 34 of the tie 14. These additional two cavities associated with the rail seat assembly 38*b* are constructed and cooperate to connect the rail seat assembly 38*b* to the upper surface 34 of the tie 14 in a manner exactly like that described before with respect to the cavities 112 and 112*a* associated with the rail seat assembly 38.

As mentioned before, ties such as the wood tie 14 typically are creosote treated. In constructing the tie 14 for accommodating the rail-tie fastening assemblies 10 and 10*b*, the cavities 112*a* and 112*b* and the like two cavities associated with the rail-tie fastening assembly 10*b* first are formed in the upper surface 34 of the tie 14. The base anchor 102 with the rail seat plate 80 connected thereto is disposed in and secured within the cavity 112 and the base anchor 102*a* with the rail seat plate 80*a* is disposed in and secured within the cavity 112*a* to connect the rail seat assembly 80*a* to the upper surface 34 of the tie 14 in the manner described before. In a like manner, the rail seat assemblies 38 of the rail-tie fastening assembly 10*b* are connected to the upper surface 34 of the tie 14. After connecting the rail seat assemblies 38 to the tie 14, the tie 14 with the four rail seat assemblies 38 secured thereon is treated with creosote.

If the tie 14 were creosote treated prior to forming the cavities 112 therein, the forming of the cavities 112 would breech the creosote barrier, a result which is not desirable. The cavities 112 could be formed in the upper surface 34 of the tie 14 and then the tie 14 could be treated with creosote prior to installing the rail seat assemblies 38. In such cases, the creosote treating would extend about the entire surface formed by the cavities 112 which may be desirable in some instances; however, the prior creosote treating could result in difficulties in the subsequent step of adhereing the rail seat assembly 38 in the cavities 112. In any event, it is preferable to creosote treat the tie 14 after the rail seat assemblies 38 have been secured thereto.

One system for securing the rail seat plate 80 in the cavity 112 is illustrated in FIG. 7. In this embodiment, an epoxy adhesive 164 initially is disposed on the bottom surface of the cavity 112. The base anchor 102 with the rail seat plate 80 connected thereto then is lowered into the cavity 112 to a position wherein the lower surface is disposed on the epoxy adhesive 164. Thereafter, the adhesive 164 is cured thereby securing the lower surface of the base anchor 102 to the bottom surface of the cavity 112. The remainder of the space in the cavity 112 not occupied by the base anchor 102, is filled with a potting compound 166 both of which then are cured, the potting compound 166 cooperating with the epoxy adhesive 164 to fill the remaining space in the cavity 112 and to secure the base anchor 102 in the cavity 112, thereby securing the rail seat plate 80 to the upper surface 34 of the tie 14. The rail seat plate **80*a* is secured to the tie 14** in exactly the same manner.

Shown in FIG. 8 is another system for installing the rail seat plate 80 on the tie 14. In this instance, an elastomeric adhesive 168 first is placed in the cavity 112. The base anchor 102 then is lowered into the cavity 112 to a position wherein its lower surface rests upon the elastomeric adhesive. The elastomeric adhesive is permitted to cure and then the remaining space within cavity 112, not occupied by the base anchor 102, is filled with a potting compound 170. The potting compound 170 is permitted to cure and the potting compound 170 cooperates with the elastomeric adhesive 168 to fill the remaining space in the cavity 112 and to secure the base anchor 102 within the cavity 112, thereby securing the rail seat plate 80 to the tie 14. The rail seat plate **80*a* is secured to the tie 14** in exactly the same manner.

In the two systems illustrated in FIGS. 7 and 8 for installing the rail seat plates 80 and **80*a*, the potting compounds 166 and 170, respectivefully, fill the cavities 112 and 112*a* to prevent water from collecting in the cavities 112 and 112*a* and to prevent dirt or organisms from gaining access to the portions of the tie 14 formed by the cavities 112 and 112*a*. Also, in these two instances, the potting compounds 166 and 170 are utilized as filler materials to reduce costs since the costs of epoxy adhesives or elastomeric adhesive generally is considerably greater than the cost of potting compounds. In either instance, the adhesive and potting compounds are cured and then the tie 14 with the rail seat assemblies 80 and 80*a*** connected thereto is creosote treated.

To remove the rail anchor 40 from assemblage with the rail seat assembly 38, the operator must move the first tine 120 and the second tine 134 generally toward each other to the compressed position wherein the seat surfaces 156 and 158 become disengaged from the first end 42 of the rail seat assembly 38. In this compressed position of the rail anchor 40, the rail anchor 40 then can be moved in the removal direction 162 through the anchor slot 54 to a position wherein the rail anchor 40 is disengaged from the rail seat assembly 38.

A removal tool 172, shown in FIG. 9, is provided to facilitate the removal of the rail anchor 40 from its assembled position with the rail seat assembly 38. An opening 178 is formed in the first end of the tool 172. Tapered surfaces 180 and 182 are formed on the sides of the opening 178.

The tapered surfaces 180 and 182 each are tapered inwardly so that the distance between the tapered surfaces 180 and 182 decreases as they extend generally from one end of the tool 172 to the other.

The distance between the two tapered surfaces 180 and 182 generally at the open end of the removal tool 172 is about equal to and slightly greater than the first end width 154 of the rail anchor 40 in the normal position of the rail anchor 40.

In operation, the operator positions the removal tool 172 generally opposite the first ends 122 and 136 of the tines 120 and 134 and, in this position, the operator moves the removal tool 172 to a position wherein the ends 122 and 136 of the tines 120 and 134 are disposed generally within the portion of the opening 178. The operator then forces the removal tool 172 generally over the tapered portions 150 and 152 of the tines 120 and 134. As the removal tool 172 is being forced over the tapered portions 150 and 152, the tapered surfaces 180 and 182 formed in the opening 178 function to move the second side 128 of the first tine 120 generally toward the second side 142 of the second tine 134 to a position wherein the tines 120 and 134 are positioned in the compressed position. The rail anchor 40 then can be moved in the removal direction 162 through the anchor slot 54 until the rail anchor 40 has been removed from the rail seat assembly 38.

As the rail anchor 40 is being moved in the removal direction 162, the first ends 122 and 136 of the first tines 120 and 134 are removed from the opening 178 in the removal tool 172. Thus, the rail anchor 40 is disengaged from the removal tool 172 as the rail anchor 40 is moved in the removal direction 162 to disengage the rail anchor 40 from the seat assembly 38.

It should be noted that, although the rail anchor 40 has been described herein as having tines 120 and 134 which are insertable through the anchor slot 54 generally between the rail seal plates 80 and **80*a*, the rail anchor 40 could be modified so the tines 120 and 134 are insertable generally about the sides 86 and 86*a* of the rail seat plates 80 and 80*a*. In this type of an embodiment, the anchor slot actually would be defined by the distance between the sides 86 and 86*a*. This is considered to be an equivalent structure to the structure shown in the drawings and described in detail before. However, the preferred embodiment is the rail anchor 40 which is insertable through the anchor slot 54**.

EMBODIMENTS OF FIGS. 11 AND 12

Figure 11:
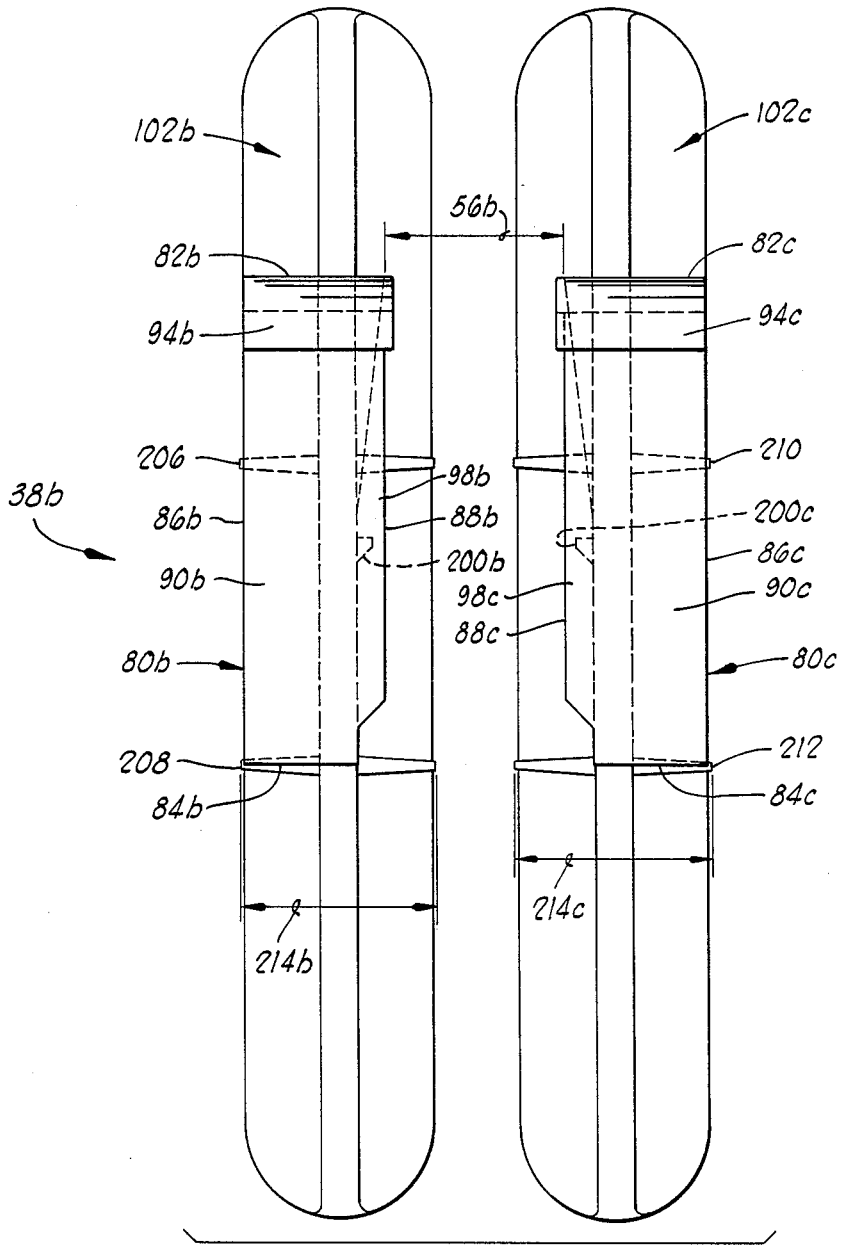
FIG. 11 is a top plan view of modified rail seat plates and modified base anchors.
Figure 12:
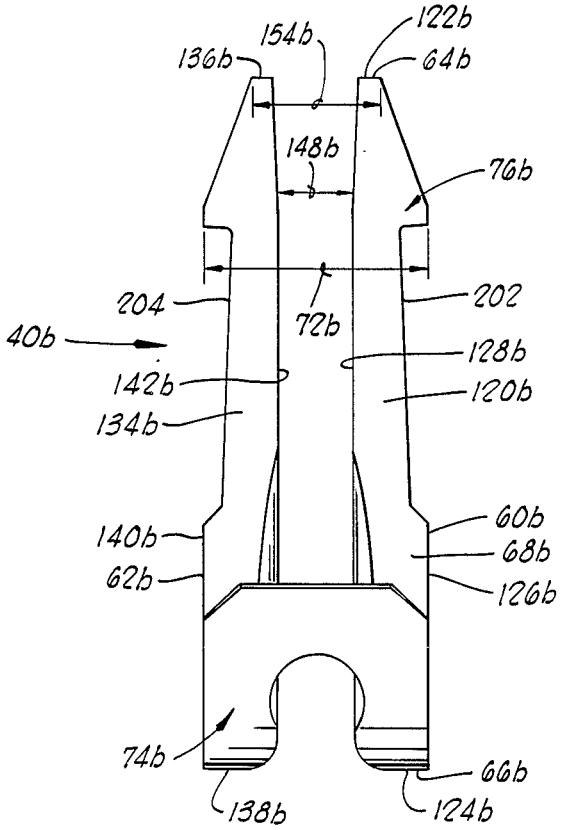
FIG. 12 is a top plan view of a modified rail anchor for use with the modified rail seat plates of FIG. 11.

Shown in FIG. 11 is a modified rail seat assembly **38*b* and shown in FIG. 12 is a modified rail anchor 40*b***.

As shown in FIG. 11, the rail seat assembly **38*b* includes two modified rail seat plates 80*b* and 80*c*. The rail seat plate 80*b* is constructed exactly like the rail seat plate 80*c*. The rail seat plates 80*b* and 80*c* are constructed exactly like the rail seat plates 80 described in detail before, except the rail seat plates 80*b* and 80*c* each include a catch flange 200*b* and 200*c*, respectively and the ears 98*b* and 98*c* are extended a longer distance along the second sides 88*b* and 88*c***, respectively.

The catch flange **200*b* is connected to the second side 88*b*, and the catch flange 200*b* extends a distance from the second side 88*b* and is disposed generally mid-way between the first and second ends 82*b* and 84*b*. The catch flange 200*c* is connected to the second side 88*c*, and the catch flange 200*c* extends a distance from the second side 88*c* and is disposed generally mid-way between the first and second ends 82*c* and 84*c***.

As shown in FIG. 12, the rail anchor **40*b* is constructed exactly like the rail anchor 40 described in detail before, except the second sides 128*b* and 142*b* of the tines 120*b* and 134*b* are not angled inwardly generally near the second end 66b and a notch 202 and 204 is formed in the first sides 126b and 140b, respectively, of the tines 120b and 134b. Actually, the notches 202 and 204 merely are extensions of the notches formed in the rail anchor 40**, for reasons which will be made more apparent below.

As shown in FIG. 11, the rail seat plates 80b and 80c each are connected to a modified base anchor 102b and 102c, respectively. The base anchors 102b and 102c are identical in construction. The base anchors 102b and 102c are constructed exactly like the base anchors 102 and 102a described in detail before, except the base anchors 102b and 102c each include two holding flanges 206, 208, 210 and 212. The holding flanges 206 and 208 are formed on the base anchor 102b and the holding flanges 210 and 212 are formed on the base anchor 102c.

The holding flanges 206 and 208 are spaced a distance apart, and the holding flanges 206 and 208 each extend a distance beyond the opposite sides of the base anchor 102b. The holding flanges 210 and 212 are spaced a distance apart and the holding flanges 210 and 212 each extend a distance beyond the opposite sides of the base anchor 102c.

A distance 214b between the opposite ends of the holding flanges 206 and 208 is slightly greater than the width of cavity 112. A distance 214c between the opposite ends of the holding flanges 210 and 212 is slightly greater than the width of cavity 112. When the base anchor 102b or 102c is disposed in the cavity 112, the ends of the holding flanges 206 and 208 or 210 and 212 engage and cut into the walls found in the tie 14 by the cavity 112. The holding flanges 206, 208, 210 and 212 cooperate to hold the base anchors 102b and 102c in position within the respective cavities 112 until the epoxy adhesive and the potting compound have had an opportunity to cure.

The rail seat plate 80b and 80c will cooperate with the rail anchor 40b to secure the rail 12 to the tie 14 in a manner exactly like that described before with respect to the rail seat plates 80 and 80a and the rail anchor 40. In addition, the rail seat plates 80b and 80c and the rail anchor 40b are constructed so the rail anchor 40b can be secured in a storage position so the rail anchor 40b is connected to the rail seat plates 80b and 80c when the assembly is shipped or during the use of the assembly to reduce inadvertent loss of rail anchors.

To position the rail anchor 40b in the storage position, the rail anchor 40b is moved in the insertion direction between the rail seat plates 80b and 80c to a position wherein the seat surfaces on the tines 120b and 134b are moved slightly beyond the catch flanges 200b and 200c. In this storage position of the rail anchor 40b, the seat surfaces cooperates with the catch flanges 200b and 200c to prevent movement of the rail anchor 40b in the removal direction. The tapered portions of the second sides 88b and 88c generally near the first end 82 and 82a cooperate to prevent further movement of the rail anchor 40b in the insertion direction until force is applied to the rail anchor 40b in the insertion direction to move the rail anchor 40b to the assembled position.

In the storage position of the rail anchor 40b, the seat hooks 94b and 94care spaced a sufficient distance from the anchor hook assembly 74b so the rail flange 16 still can be disposed on the upper surfaces 90b and 90c of the rail seat plates 80b and 80c. After the rail flange 16 is disposed on the rail seat plates 80b and 80c, the rail anchor 40b is moved in the insertion direction to the assembled position for connecting the rail 12 to the rail seat assembly 38b and the rail anchor 40b. Thus, the rail seat assembly 38b and the rail anchor 40b operate in a manner exactly like the described before with respect to the rail seat assembly 38 and the rail anchor 40, except the rail anchor 40b is moveable to the storage position so the rail anchor 40b can remain connected to the rail seat assembly 38b during shipment and during use. The notches 202 and 204 provide clearances for the catch flanges 200b and 200c as the rail anchor 40b is moved from the storage position to the assembled position.

Changes may be made in the various components, elements and assemblies described herein and changes may be made in the steps or sequence of steps of the methods described herein without departing from the spirit and the scope of the invention as defined in the following claims.

I claim:

1. A rail-tie fastening assembly for connecting a rail having a rail flange with an upper surface, a lower surface, a first side and a second side to a tie having an upper surface, comprising:

a rail seat assembly connectable to the upper surface of the tie having a first end, a second end, a first side, a second side, an upper surface, a lower surface and an anchor slot formed through a portion thereof, the anchor slot having a predetermined slot width, a seat hook assembly being formed on the rail seat assembly generally near the first end of the rail seat assembly and being adapted to extend a distance generally over a portion of the upper surface of the rail flange generally near the first side of the rail flange; and a rail anchor having a first side, a second side, a first end and a second end, the rail anchor being operatively associated with the rail seat assembly and being movable from a normal position to a compressed position, the rail anchor having an anchor width extending generally between the first and second sides thereof, the anchor width being greater than the slot width of the anchor slot formed in the rail seat assembly in the normal position of the rail anchor and the anchor width being less than the slot width of the anchor slot formed in the rail seat assembly in the compressed position of the rail anchor, an anchor hook assembly being formed on the rail anchor generally near the second end of the rail anchor, a portion of the anchor hook assembly being adapted to extend a distance generally over a portion of the upper surface of the rail flange generally near the second side of the rail flange, and the first end of the rail anchor being insertable in the anchor slot generally near the second end of the rail seat assembly in the compressed position of the rail anchor and the rail anchor being movable through the anchor slot to an assembled position wherein the anchor hook extends over a portion of the upper surface of the rail flange generally near the second side of the rail flange and the rail anchor being movable to the normal position in the assembled position of the rail anchor for cooperating to hold the rail anchor in the assembled position.

2. The rail-tie fastening assembly of claim 1 wherein the rail anchor is defined further to include:

seat engaging means being formed on the rail anchor for engaging a portion of the rail seat assembly when the rail anchor is in the assembled position.

3. The rail-tie fastening assembly of claim 1 wherein the seat hook assembly is defined further to include a portion engageable with the first side of the rail flange, and wherein the anchor hook assembly is defined further to include a portion engageable with the second side of the rail flange in the assembled position of the rail anchor connected to the rail seat assembly.

4. The rail-tie fastening assembly of claim 2 wherein the seat engaging means is defined further as engaging a portion of the first end of the rail seat assembly in the normal position of the rail anchor and in the assembled position of the rail anchor connected to the rail seat assembly.

5. The rail-tie fastening assembly of claim 4 wherein the anchor slot is defined further as extending through the rail seat assembly and intersecting the first and the second ends of the rail seat assembly, a portion of the rail anchor including the seat engaging means extending through the anchor slot and beyond the first end of the rail seat assembly in the normal and assembled position of the rail anchor.

6. The rail-tie fastening assembly of claim 1 wherein the rail anchor is defined further to include an upper surface and a lower surface, and wherein the rail seat assembly is defined further to include:

ear means extending a distance into the anchor slot and being spaced a distance above the upper surface of the rail anchor in an assembled position to permit vertical movement of the rail and the rail anchor within the space defined by the distance between the ear means and the upper surface of the rail anchor in the assembled and normal position of the rail anchor.

7. The rail-tie fastening assembly of claim 6 wherein the seat hook assembly is defined further to include a portion engageable with the first side of the rail flange, and wherein a portion of the anchor hook assembly is defined further as being engageable with the second side of the rail flange, the seat hook assembly and the anchor hook assembly cooperating substantially to restrain lateral movement of the rail flange in the assembled and normal position of the rail anchor.

8. The rail-tie fastening assembly of claim 7 wherein the anchor hook assembly is defined further as being engageable with the upper surface of the rail flange, and wherein the portion of the seat hook assembly extending generally over the upper surface of the rail flange is defined further as being spaced a distance from the upper surface of the rail flange to cooperate with the space between the ear means and the upper surface of the rail anchor to permit limited vertical movement of the rail.

9. The rail-tie fastening assembly of claim 8 wherein the ear means is defined further as being disposed near the second end of the rail seat assembly.

10. The rail-tie fastening assembly of claim 1 wherein the rail anchor is defined further to include:

a first tine having a first end, a second end, a first side, a second side, an upper surface and a lower surface;

a second tine having a first end, a second end, a first side, a second side, an upper surface and a lower surface; and means for connecting the second end of the first tine to the second end of the second tine, the upper surface of the first tine being in a substantially coplanar disposition with the upper surface of the second tine and the lower surface of the first tine being in a substantially coplanar disposition with the lower surface of the second tine, the second side of the first tine being spaced a distance from the second side of the second tine, the first ends of the first and second tines cooperating to form the first end of the rail anchor and the second ends of the first and second tines cooperating to form the second end of the rail anchor and the upper surfaces of the first and second tines cooperating to form the upper surface of the rail anchor and the lower surfaces of the first and the second tines cooperating to form the lower surface of the rail anchor, the first side of the first tine forming the first side of the rail anchor and the first side of the second tine forming the second side of the rail anchor, the anchor width being the distance between the first side of the first tine and the first side of the second tine, the first tine being movable generally toward the second tine to move the rail anchor to the compressed position and the first tine being moveable generally away from the second tine to move the rail anchor to the normal position.

11. The rail-tie fastening assembly of claim 10 wherein the anchor hook assembly is defined further to include a portion connected to the second end of the first tine and a portion connected to the second end of the second tine, the anchor hook assembly cooperating to form the means for connecting the second end portions of the first and second tines.

12. The rail-tie fastening assembly of claim 10 wherein the first tine is defined further as having a tapered portion formed on the first side generally near and intersecting the first end, and wherein the second tine is defined further as having a tapered portion formed on the first side generally near and intersecting the first end, the tapered portions on the first and second tines cooperating to provide a first end width less than the slot width and less than the anchor width in the normal position of the rail anchor, the tapered portions of the first and second tines being insertable into the anchor slot generally at the second end of the rail seat assembly and the rail anchor being moved to the compressed position as the tapered portions on the first and second tines are moved into the anchor slot.

13. The rail-tie fastening assembly of claim 12 wherein the anchor slot extends through the rail seat assembly intersecting the first and second ends, and wherein the first tine is defined further to include a seat surface formed on the first side and spaced a distance from the first end, the seat surface generally facing the second end of the first tine, and wherein the second tine is defined further to include a seat surface formed on the first side and spaced a distance from the first end, the seat surface of the first tine being generally aligned with the seat surface on the second tine, the first and second tines and a length of the anchor slot generally between the first and second ends of the rail seat assembly being sized so that, in the assembled position of the rail anchor, the first end of the rail anchor extends a distance beyond the first end of the rail seat assembly and the rail anchor moves to the normal position wherein the seat surfaces on the first and second tines engage portions of the first end of the rail seat assembly to secure the rail anchor in the assembled position and prevent movement of the rail anchor in a direction generally from the first end toward the second end of the rail seat assembly.

14. The rail-tie fastening assembly of claim 1 wherein the tie is defined further as having a cavity formed in the upper surface and extending a distance into the tie, and wherein the rail-tie fastening assembly is defined further to include:

base anchor means connected to the lower surface of the rail seat assembly and the base anchor means extending a distance from the lower surface of the rail seat assembly, the base anchor means being disposeably within the cavity in the tie to a position wherein the lower surface of the rail seat assembly is disposed in a plane generally coplanar with the upper surface of the tie; and means for securing the base anchor means in the cavity in the tie.

15. The rail-tie fastening assembly of claim 1 wherein the rail seat assembly is defined further to include:

a first seat plate having an upper surface, a lower surface, a first end, a second end, a first side and a second side, a first seat hook being formed on the first end of the first seat plate and the first seat hook being extendable a distance generally over a portion of the upper surface of the rail flange; and a second seat plate having an upper surface, a lower surface, a first end, a second end, a first side and a second side, a second seat hook being formed on the first end of the second seat plate and the second seat hook being extendable a distance generally over a portion of the upper surface of the rail flange, the first and second seat hook cooperating to form the seat hook assembly, the second side of the second seat plate being spaced a distance from the second side of the first seat plate and a space between the second sides of the first and second seat plates forming the anchor slot, the first ends of the first and second seat plates cooperating to form the first end of the rail seat assembly and the second ends of the first and second seat plates cooperating to form the second end of the rail seat assembly and the upper surfaces of the first and second seat plates cooperating to form the upper surface of the rail seat assembly and the lower surfaces of the first and second seat plates cooperating to form the lower surface of the rail seat assembly, the first side of the first seat plate forming the first side of the rail seat assembly and the first side of the second seat plate forming the second side of the rail seat assembly.

16. The rail-tie assembly of claim 15 wherein the first seat hook and the second seat hook each are defined further to include a portion engageable with the first side of the rail flange, and wherein the anchor hook assembly is defined further to include a portion engageable with the second side of the rail flange in the assembled position of the rail anchor connected to the rail seat assembly.

17. The rail-tie fastening assembly of claim 15 wherein the first rail seat plate is defined further to include:

an ear connected to the second side of the first rail seat plate and extending a distance into the anchor slot, the ear being spaced a distance above the lower surface of the first rail seat plate and the ear being spaced a distance above the upper surface of the rail anchor in the assembled position of the rail anchor; and wherein the second rail seat plate is defined further to include:

an ear connected to the second side of the second rail seat plate and extending a distance into the anchor slot, the ear being spaced a distance above the lower surface of the second rail seat plate and the ear being spaced a distance above the upper surface of the rail anchor in the assembled position of the rail anchor, the ears on the first and second rail seat plates cooperating to permit vertical movement of the rail and the rail anchor within the spaces defined by the distances between the ears and the upper surface of the rail anchor.

18. The rail-tie fastening assembly of claim 17 wherein the first and the second seat hook each are defined further to include a portion engageable with the first side of the rail flange, and wherein a portion of the anchor hook assembly is defined further as being engageable with the second side of the rail flange substantially to restrain lateral movement of the rail flange.

19. The rail-tie fastening assembly of claim 18 wherein the portions of the first and second seat hooks which are extendable generally over the upper surface of the rail flange each are defined further as being spaced a distance from the upper surface of the rail flange for cooperating with the ears on the first and second rail seat plates to permit limited vertical movement of the rail.

20. The rail-tie fastening assembly of claim 19 wherein the lower surface of the rail flange is disposed on the upper surfaces of the first and second rail seat plates in the assembled position of rail-tie fastening assembly connected to the rail flange.

21. The rail-tie fastening assembly of claim 19 wherein the ears each are defined further as being disposed generally near the respective second ends of the first and second rail seat plates.

22. A rail-tie fastening assembly for connecting a rail having a rail flange with an upper surface, a lower surface, a first side and a second side to a tie having an upper surface, comprising:

a rail seat assembly connectable to the upper surface of the tie having a first end, a second end, a first side, a second side, an upper surface and a lower surface, a seat hook assembly being formed on the rail seat assembly generally near the first end of the rail seat assembly and being adapted to engage the first side of the rail flange and to extend a distance generally over a portion of the upper surface of the rail flange generally near the first side of the rail flange, the seat hook assembly being spaced a distance from the upper surface of the rail flange; and a rail anchor having a first side, a second side, a first end and a second end, an anchor hook assembly being formed on the rail anchor generally near the second end of the rail anchor, a portion of the anchor hook assembly being adapted to extend a distance generally over and engage a portion of the upper surface of the rail flange generally near the second side of the rail flange and a portion of the anchor hook assembly being engageable with the second side of the rail flange, the rail anchor being connectable to the rail seat assembly in an assembled position to permit limited vertical movement of the anchor hook assembly and portion of the rail flange engaged thereby.

23. The rail-tie fastening assembly of claim 22 wherein the rail anchor is defined further to include an upper surface and a lower surface, and wherein the rail seat assembly is defined further to include:

ear means disposed on a portion of the rail seat assembly and being spaced a distance above the upper surface of the rail anchor in an assembled position to permit vertical movement of the rail and the rail anchor within the space defined by the distance between the ear means and the upper surface of the rail anchor.

24. The rail-tie fastening assembly of claim 22 wherein the tie is defined further as having a cavity formed in the upper surface and extending a distance into the tie, and wherein the rail-tie fastening assembly is defined further to include:

base anchor means connected to the lower surface of the rail seat assembly and extending a distance therefrom, the base anchor means being disposable within the cavity in the tie to a position wherein the lower surface of the rail seat assembly is disposed in a plane generally coplanar with the upper surface of the tie; and means for securing the base anchor means in the cavity in the tie.

25. The rail-tie fastening assembly of claim 22 wherein the rail seat assembly is defined further to include an anchor slot formed through a portion thereof, and wherein the rail anchor is defined further as being insertable through a portion of the anchor slot to an assembled position, and wherein the rail seat assembly is defined further to include:

a first rail seat plate having an upper surface, a lower surface, a first end, a second end, a first side and a second side, a first seat hook being formed on the first end of the first rail seat plate and the first seat hook being engageable with the first side of the rail flange and extendable a distance generally over and spaced a distance from a portion of the upper surface of the rail flange; and a second rail seat plate having an upper surface, a lower surface, a first end, a second end, a first side and a second side, a second seat hook being formed on the first end of the second rail seat plate and the second seat hook being engageable with the second side of the rail flange and extendable a distance generally over and spaced a distance from a portion of the upper surface of the rail flange, the first and second seat hooks cooperating to form the seat hook assembly, the second side of the second rail seat plate being spaced a distance from the second side of the first rail seat plate and a space between the second sides of the first and second rail seat plates forming the anchor slot, the first ends of the first and second rail seat plates cooperating to form the first end of the rail seat assembly and the second ends of the first and second rail seat plates cooperating to form the second end of the rail seat assembly and the upper surfaces of the first and second rail seat plates cooperating to form the upper surface of the rail seat assembly and the lower surfaces of the first and second rail seat plates cooperating to form the lower surface of the rail seat assembly, the first side of the first rail seat plates forming the first side of the rail seat assembly and the first side of the second rail seat plate forming the second side of the rail seat assembly.

26. The rail-tie fastening assembly of claim 25 wherein the first rail seat plate is defined further to include:

an ear connected to the second side of the first rail seat plate and extending a distance into the anchor slot, the ear being spaced a distance above the lower surface of the first rail seat plate and the ear being spaced a distance above the upper surface of the rail anchor in the assembled position of the rail anchor; and wherein the second rail seat plate is defined further to include:

an ear connected to the second side of the second rail seat plate and extending a distance into the anchor slot, the ear being spaced a distance above the lower surface of the second rail seat plate and the ear being spaced a distance above the upper surface of the rail anchor in the assembled position of the rail anchor the ears on the first and second rail seat plates cooperating to permit vertical movement of the rail and the rail anchor within the spaces defined by the distances between the ears and the upper surface of the rail anchor.

27. The rail-tie assembly of claim 26 wherein the lower surface of the rail flange is disposed on the upper surfaces of the first and second rail seat plates in the assembled position of rail-tie fastening assembly connected to the rail flange.

28. The rail-tie fastening assembly of claim 26 wherein the ears each are defined further as being disposed generally near the respective second ends of the first and second rail seat plates.

29. A rail-tie fastening assembly adapted for use with a rail having a rail flange, comprising:

a tie having an upper surface with cavity means formed in a portion thereof of the upper surface;

a base anchor means disposed in the cavity means in the tie after the cavity means has been formed in the tie, the cavity means having a sufficient size whereby the base anchor means is disposable within the cavity means;

means for connecting the base anchor means to the tie, comprising;

compound means disposed in the cavity means whereby the compound means covers at least a portion of the portion of the base anchor means disposed in the cavity means and whereby the compound means substantially fills the portion of the cavity means not occupied by the base anchor means and cooperates to secure the base anchor means in the cavity means.

means connected to the base anchor means and connectable to the rail flange for connecting the rail to the tie via the base anchor means.

30. The rail-tie fastening assembly of claim 29 wherein the rail flange includes opposite sides, and wherein the means for connecting the rail flange to the tie is defined further as having portions engaging opposite sides of the rail flange substantially to restrain lateral movement of the rail.

31. The rail-tie fastening assembly of claim 30 wherein the rail flange is defined further to include an upper surface and wherein the means for connecting the rail flange to the tie is defined further as having portion engageable with a portion of the upper and lower surfaces of the rail flange substantially to restrain longitudinal movement of the rail while permitting movement of the rail in generally vertically upwardly and generally vertically downwardly directions within predetermined limits.

32. A rail-tie fastening assembly adapted for use with a rail having a rail flange with an upper surface, a lower surface, a first side and a second side, comprising:

a tie having cavity means formed in a portion thereof;

a base anchor means disposed in the cavity means in the tie;

means for connecting the base anchor means to the tie; and means connected to the base anchor means and connectable to the rail flange for connecting the rail to the tie via the base anchor means, comprising:

a rail seat assembly connected to the base anchor means and having a first end, a second end, a first side, a second side, an upper surface and a lower surface, a seat hook assembly being formed on the rail seat assembly generally near the first end of the rail seat assembly and being adapted to engage the first side of the rail flange and to extend a distance generally over a portion of the upper surface of the rail flange generally near the first side of the rail flange, the seat hook assembly being spaced a distance from the upper surface of the rail flange; and a rail anchor having a first side, a second side, a first end and a second end, an anchor hook assembly being formed on the rail anchor generally near the second end of the rail anchor, a portion of the anchor hook assembly being adapted to extend a distance generally over and engage a portion of the upper surface of the rail flange generally near the second side of the rail flange and a portion of the anchor hook assembly being engageable with the second side of the rail flange, the rail anchor being connectable to the rail seat assembly in an assembled position and engageable with a portion of the upper and lower surfaces of the rail flange substantially to restrain longitudinal movement of the rail while permitting movement of the rail in vertically upwardly and downwardly directions within predetermined limits, the anchor hook assembly being engageable with the second side of the rail flange and the rail seat assembly being engagable with the first side of the rail flange to restrain lateral movement of the rail in an assembled position of the rail anchor.

33. The rail-tie fastening assembly of claim 32 wherein the rail anchor is defined further to include an upper surface and a lower surface, and wherein the rail seat assembly is defined further to include:

ear means disposed on a portion of the rail seat assembly and being spaced a distance above the upper surface of the rail anchor in an assembled position to permit vertical movement of the rail and the rail anchor within the space defined by the distance between the ear means and the upper surface of the rail anchor.

34. The rail-tie fastening assembly of claim 32 wherein the rail seat assembly is defined further to include an anchor slot formed through a portion thereof, and wherein the rail anchor is defined further as being insertable through a portion of the anchor slot to an assembled position, and wherein the cavity means in the tie is defined further to include two cavities formed in an upper surface of the tie with the two cavities being spaced a predetermined distance apart, and wherein the base anchor means is defined further to include two base anchors, one base anchor being disposed in one of the cavities and the other base anchor being disposed in the other cavity, and wherein the means for connecting the base anchor means to the tie is defined further to include means for connecting each base anchor to the tie, and wherein the rail seat assembly is defined further to include:

a first seat plate having an upper surface, a lower surface, a first end, a second end, a first side and a second side, a first seat hook being formed on the first end of the first rail seat plate and the first seat hook being engagable with the first side of the rail flange and adapted to extend a distance generally over and spaced a distance from a portion of the upper surface of the rail flange; and a second seat plate having an upper surface, a lower surface, a first end, a second end, a first side and a second side, a second seat hook being formed on the first end of the second rail seat plate and the second seat hook being engagable with the first side of the rail flange and extendable a distance generally over and spaced a distance from a portion of the upper surface of the rail flange, the first and second seat hooks cooperating to form the seat hook assembly, the second side of the second rail seat plate being spaced a distance from the second side of the first rail seat plate and a space between the second sides of the first and second rail seat plates forming the anchor slot, the first ends of the first and second rail seat plates cooperating to form the first end of the rail seat assembly and the second ends of the first and the second seat plates cooperating to form the second end of the rail seat assembly and the upper surfaces of the first and second rail seat plates cooperating to form the upper surface of the rail seat assembly and the lower surfaces of the first and second rail seat plates cooperating to form the lower surface of the rail seat assembly, the first side of the first rail seat plate forming the first side of the rail seat assembly and the first side of the second rail seat plate forming the second side of the rail seat assembly.

35. The rail-tie fastening assembly of claim 34 wherein the first rail seat plate is defined further to include:

an ear connected to the second side of the first rail seat plate and extending a distance into the anchor slot, the ear being spaced a distance above the lower surface of the first rail seat plate and the ear being spaced a distance above the upper surface of the rail anchor in the assembled position of the rail anchor; and wherein the second rail seat plate is defined further to include:

an ear connected to the second side of the second rail seat plate and extending a distance into the anchor slot, the ear being spaced a distance above the lower surface of the second rail seat plate and the ear being spaced a distance above the upper surface of the rail anchor in the assembled position of the rail anchor, the ears on the first and second rail seat plates cooperating to permit vertical movement of the rail and the rail anchor within the spaces defined by the distances between the ears and the upper surface of the rail anchor.

36. The rail-tie fastening assembly of claim 35 wherein the lower surface of the rail flange is disposed on the upper surfaces of the first and the second rail seat plates in the assembled position of the rail tie fastening assembly connected to the rail flange.

37. The rail-tie fastening assembly of claim 35 wherein the ears each are defined further as being disposed generally near the respective second ends of the first and the second rail seat plates.

38. The rail-tie fastening assembly of claim 32 wherein the rail anchor is defined further to include:

seat engaging means being formed on the rail anchor for engaging a portion of the rail seat assembly when the rail anchor is in the assembled position.

39. The rail-tie fastening assembly of claim 38 wherein the seat engaging means is defined further as engaging a portion of the first end of the rail seat assembly in the normal position of the rail anchor and in the assembled position of the rail anchor connected to the rail seat assembly.

40. The rail-tie fastening assembly of claim 32 wherein the seat hook assembly is defined further to include a portion engageable with the first side of the rail flange, and wherein a portion of the anchor hook assembly is defined further as being engageable with the second side of the rail flange, the seat hook assembly and the anchor hook assembly cooperating substantially to restrain lateral movement of the rail flange in the assembled and normal position of the rail anchor.

41. The rail-tie fastening assembly of claim 40 wherein the anchor hook assembly is defined further as being engageable with the upper surface of the rail flange for substantially restraining longitudinal movement of the rail and wherein the portion of the seat hook assembly extending generally over the upper surface of the rail flange is defined further as being spaced a distance from the upper surface of the rail flange, the rail anchor being moveable to permit vertical movement of the rail within predetermined limits.

42. A rail-tie fastening assembly adapted for use with a rail having a rail flange with an upper surface, a lower surface, a first side and a second side, comprising:

a tie having cavity means formed in a portion thereof;

a base anchor means disposed in the cavity means in the tie;

means for connecting the base anchor means to the tie; and means connected to the base anchor means and connectable to the rail flange for connecting the rail to the tie via the base anchor means, comprising:

a rail seat assembly connected to the base anchor means and having a first end, a second end, a first side, a second side, an upper surface, a lower surface and an anchor slot formed through a portion thereof, the anchor slot having a predetermined slot width, a seat hook assembly being formed on the rail seat assembly generally near the first end of the rail seat assembly and being adapted to extend a distance generally over a portion of the upper surface of the rail flange generally near the first side of the rail flange; and a rail anchor having a first side, a second side, a first end and a second end, the rail anchor being operatively associated with the rail seat assembly and being movable from a normal position to a compressed position, the rail anchor having an anchor width extending generally between the first and second sides thereof, the anchor width being greater than the slot width of the anchor slot formed in the rail seat assembly in the normal position of the rail anchor and the anchor width being less than the slot width of the anchor slot formed in the rail seat assembly in the compressed position of the rail anchor, an anchor hook assembly being formed on the rail anchor generally near the second end of the rail anchor, a portion of the anchor hook assembly being adapted to extend a distance generally over a portion of the upper surface of the rail flange generally near the second side of the rail flange, and the first end of the rail anchor being insertable in the anchor slot generally near the second end of the rail seat assembly in the compressed position of the rail anchor and the rail anchor being movable through the anchor slot to an assembled position wherein the anchor hook extends over a portion of the upper surface of the rail flange generally near the second side of the rail flange and the rail anchor being movable to the normal position in the assembled position of the rail anchor for cooperating to hold the rail anchor in the assembled position.

43. The rail-tie fastening assembly of claim 42 wherein the seat hook assembly is defined further to include a portion engageable with the first side of the rail flange, and wherein the anchor hook assembly is defined further to include a portion engageable with the second side of the rail flange in the assembled position of the rail anchor connected to the rail seat assembly for cooperating substantially to restrain lateral movement of the rail.

44. The rail-tie fastening assembly of claim 42 wherein the anchor slot is defined further as extending through the rail seat assembly and intersecting the first and the second ends of the rail seat assembly, a portion of the rail anchor including the seat engaging means extending through the anchor slot and beyond the first end of the rail seat assembly in the normal and assembled position of the rail anchor.

45. The rail-tie fastening assembly of claim 42 wherein the rail anchor is defined further to include an upper surface and a lower surface, and wherein the rail seat assembly is defined further to include:

ear means extending a distance into the anchor slot and being spaced a distance above the upper surface of the rail anchor in an assembled position to permit vertical movement of the rail and the rail anchor within the space defined by the distance between the ear means and the upper surface of the rail anchor in the assembled and normal position of the rail anchor.

46. The rail-tie fastening assembly of claim 42 wherein the rail anchor is defined further to include:

a first tine having a first end, a second end, a first side, a second side, an upper surface and a lower surface;

a second tine having a first end, a second end, a first side, a second side, an upper surface and a lower surface; and means for connecting the second end portion of the first tine to the second end portion of the second tine, the upper surface of the first tine being in a substantially coplanar disposition with the upper surface of the second tine and the lower surface of the first tine being in a substantially coplanar disposition with the lower surface of the second tine, the second side of the first tine being spaced a distance from the second side of the second tine, the first ends of the first and second tines cooperating to form the first end of the rail anchor and the second ends of the first and second tines cooperating to form the second end of the rail anchor and the upper surfaces of the first and second tines cooperating to form the upper surface of the rail anchor and the lower surfaces of the first and the second tines cooperating to form the lower surface of the rail anchor, the first side of the first tine forming the first side of the rail anchor and the first side of the second tine forming the second side of the rail anchor, the anchor width being the distance between the first side of the first tine and the first side of the second tine, the first tine being movable generally toward the second tine to move the rail anchor to the compressed position and the first tine being moveable generally away from the second tine to move the rail anchor to the normal position.

47. The rail-tie fastening assembly of claim 46 wherein the anchor hook assembly is defined further to include a portion connected to the second end of the first tine and a portion connected to the second end of the second tine, the anchor hook assembly cooperating to form the means for connecting the second end portions of the first and second tines.

48. The rail-tie fastening assembly of claim 47 wherein the first tine is defined further as having a tapered portion formed on the first side generally near and intersecting the first end, and wherein the second tine is defined further as having a tapered portion formed on the first side generally near and intersecting the first end, the tapered portions on the first and second tines cooperating to provide a first end width less than the slot width and less than the anchor width in the normal position of the rail anchor, the tapered portions of the first and second tines being insertable into the anchor slot generally at the second end of the rail seat assembly and the rail anchor being moved to the compressed position as the tapered portions on the first and second tines are moved into the anchor slot.

49. The rail-tie fastening assembly of claim 48 wherein the anchor slot extends through the rail seat assembly intersecting the first and second ends, and wherein the first tine is defined further to include a seat surface formed on the first side and spaced a distance from the first end, the seat surface generally facing the second end of the first tine, and wherein the second tine is defined further to include a seat surface formed on the first side and spaced a distance from the first end, the seat surface of the first tine being generally aligned with the seat surface on the second tine, the first and second tines and a length of the anchor slot generally between the first and second ends of the rail seat assembly being sized so that, in the assembled position of the rail anchor, the first end of the rail anchor extends a distance beyond the first end of the rail seat assembly and the rail anchor moves to the normal position wherein the seat surfaces on the first and second tines engage portions of the first end of the rail seat assembly to secure the rail anchor in the assembled position and prevent movement of the rail anchor in a direction generally from the first end toward the second end of the rail seat assembly.

50. The rail-tie fastening assembly of claim 42 wherein the cavity means in the tie is defined further to include two cavities formed in an upper surface of the tie with the two cavities being spaced a distance apart, and wherein the base anchor means is defined further to include two base anchors with one base anchor being disposed in one of the cavities and the other base anchor being disposed in the other cavity, and wherein the means for connecting the base anchor means to the tie is defined further to include means for connecting each base anchor to the tie, and wherein the rail seat assembly is defined further to include:

a first rail seat plate having an upper surface, a lower surface, a first end, a second end, a first side and a second side, a first seat hook being formed on the first end of the first rail seat plate and the first seat hook being extendable a distance generally over a portion of the upper surface of the rail flange; and a second rail seat plate having an upper surface, a lower surface, a first end, a second end, a first side and a second side, a second seat hook being formed on the first end of the second rail seat plate and the second seat hook being extendable a distance generally over a portion of the upper surface of the rail flange, the first and second seat hook cooperating to form the seat hook assembly, the second side of the second rail seat plate being spaced a distance from the second side of the first rail seat plate and the space between the second sides of the first and second rail seat plates forming the anchor slot, the first ends of the first and second rail seat plates cooperating to form the first end of the rail seat assembly and the second ends of the first and second rail seat plates cooperating to form the second end of the rail seat assembly and the upper surfaces of the first and second rail seat plates cooperating to form the upper surface of the rail seat assembly and the lower surfaces of the first and second rail seat plates cooperating to form the lower surface of the rail seat assembly, the first side of the first seat rail plates forming the first side of the rail seat assembly and the first side of the second rail seat plate forming the second side of the rail seat assembly.

51. The rail-tie fastening assembly of claim 50 wherein the first seat hook and the second seat hook each are defined further to include a portion engageable with the first side of the rail flange, and wherein the anchor hook assembly is defined further to include a portion engageable with the second side of the rail flange in the assembled position of the rail anchor connected to the rail seat assembly for cooperating to substantially restrain lateral movement of the rail.

52. The rail-tie assembly of claim 51 wherein the first rail seat plate is defined further to include:

an ear connected to the second side of the first rail seat plate and extending a distance into the anchor slot, the ear being spaced a distance above the lower surface of the first rail seat plate and the ear being spaced a distance above the upper surface of the rail anchor in the assembled position of the rail anchor; and wherein the second rail seat plate is defined further to include:

an ear connected to the second side of the second rail seat plate and extending a distance into the anchor slot, the ear being spaced a distance above the lower surface of the second rail seat plate and the ear being spaced a distance above the upper surface of the rail anchor in the assembled position of the rail anchor, the ears on the first and second rail seat plates cooperating to permit vertical movement of the rail and the rail anchor within the spaces defined by the distances between the ears and the upper surface of the rail anchor.

53. The rail-tie fastening assembly of claim 52 wherein the portions of the first and second seat hooks which are extendable generally over the upper surface of the rail flange each are defined further as being spaced a distance from the upper surface of the rail flange for cooperating with the ears on the first and second rail seat plates to permit limited vertical movement of the rail.

54. The rail-tie fastening assembly of claim 53 wherein the anchor hook assembly is defined further to include a portions engageable with the upper and lower surfaces of the rail flange for substantially preventing longitudinal movement of the rail.

55. The rail-tie fastening assembly of claim 54 wherein the lower surface of the rail flange is disposed on the upper surfaces of the first and second rail seat plates in the assembled position of rail-tie fastening assembly connected to the rail flange.

56. The rail-tie fastening assembly of claim 55 wherein the ears each are defined further as being disposed generally near the respective second ends of the first and second rail seat plates.

57. A method for connecting a rail having a rail flange with an upper surface, a lower surface, a first side and a second side to a tie having a first end, a second end and an upper surface using a rail-tie fastening assembly means comprising the steps:

forming cavity means in the tie having a sufficient size so a portion of the rail-tie fastening assembly means is disposable with the cavity means;

disposing at least a portion of the rail-tie fastening assembly means in the cavity means after forming the cavity means in the tie;

securing the rail-tie fastening assembly means in the cavity means, the rail tie-fastening assembly means connectable to the rail for connecting the rail to the tie, comprising;

disposing compound means in the cavity means whereby the compound means covers at least a portion of the portion of the rail-tie fastening means disposed in the cavity means and whereby the compound means substantially fills the portion of the cavity means not occupied by the portion of the rail-tie fastening means disposed in the cavity means and cooperates to secure the rail-tie fastening means in the cavity means.

58. The method of claim 57 defined further to comprise the step of:

connecting the rail-tie fastening assembly means to the rail so portions of the rail-tie fastening assembly engages the first and second sides of the rail flange substantially to restrain lateral movement of the rail.

59. The method of claim 58 wherein the step of connecting the rail-tie fastening assembly means to the rail is defined further as connecting the rail-tie fastening assembly means to at least portions of the rail so a portion of the rail-tie fastening assembly engages portions of the upper and lower surfaces of the rail flange substantially to restrain longitudinal movement of the rail.

60. The method of claim 59 wherein the step of connecting the rail-tie fastening assembly to the rail is defined further to include permitting movement of the rail in vertically upwardly and vertically downwardly directions within a predetermined limit.

61. The method of claim 57 defined further to include the step of:

treating with creosote the tie, after securing the rail-tie fastening assembly means in the cavity means.

62. A method for connecting a rail having a rail flange with an upper surface, a lower surface, a first side and a second side to a tie having a first end, a second end and an upper surface, using a pair of rail seat plates wherein each rail seat plate is connected to a base anchor means and a rail anchor, comprising the steps of:

forming a first cavity in the upper surface of the tie, generally near the first end of the tie;

forming a second cavity in the upper surface of the tie generally near the first end of the tie, the second cavity extending generally parallel with the first cavity and being spaced a distance therefrom;

disposing the base anchor means having the first rail seat plate connected thereto the first cavity in the tie, the first cavity being sized with respect to the base anchor means connected to the first rail seat plate so that the first seat plate is disposed generally on the upper surface of the tie when the base anchor means with the first rail seat plate connected thereto is disposed in the first cavity;

securing the base anchor means with the first rail seat plate connected thereto in the cavity;

disposing the base anchor means having the second rail seat plate connected thereto in the second cavity in the tie, the second cavity in the tie being sized with respect to the base anchor means connected to the second rail plate so that the second rail plate is disposed generally on the upper surface of the tie when the base anchor means with the second rail seat plate is connected thereto is disposed in the first cavity; and securing the base anchor means with the second rail seat plate connected thereto in the second cavity, the first rail seat plate and the second rail seat plate each being sized and positioned in the respective first and second cavities so that a space is formed between the first and the second rail seat plates defining an anchor slot, the rail anchor being movable through a portion of the anchor slot for connecting the rail anchor to the first and the second rail slot plates.

63. The method of claim 62 defined further to include the steps of:

disposing a portion of the rail flange on the rail seat plates; and connecting the rail anchor to the rail seat plates so portions of the rail seat plates and the rail anchor engage the first and second sides of the rail flange substantially to restrain lateral movement of the rail.

64. The method of claim 63 wherein the step of connecting the rail anchor to the rail seat plates is defined further as connecting the rail anchor to the rail seat plates so a portion of the rail anchor engages portions of the upper and lower surfaces of the rail flange substantially to restrain longitudinal movement of the rail.

65. The method of claim 64 wherein the step of connecting the rail anchor to the rail seat plates is defined further to include permitting movement of the rail in vertically upwardly and vertically downwardly directions within a predetermined limit.

66. The method of claim 62 defined further to include the step of:

treating the tie with creosote after securing the first and the second rail seat plates in the respective first and second cavities.

* * * * *

Disclaimer and Dedication 4,874,128—S. Hudson Owen, Marshfield, Wis. RAIL-TIE FASTENING ASSEMBLY. Patent dated Oct. 17, 1989. Disclaimer and dedication filed Apr. 30, 2003, by the assignee, Kerr-McGee Chemical LLC.

Hereby disclaims and dedicates to the Public, the remaining term of said patent.

*(Official Gazette, July 15, 2003)*